US011828191B2

(12) United States Patent
Joly et al.

(10) Patent No.: US 11,828,191 B2
(45) Date of Patent: Nov. 28, 2023

(54) ASSEMBLY FOR TURBOMACHINE

(71) Applicant: SAFRAN AIRCRAFT ENGINES, Paris (FR)

(72) Inventors: Philippe Gérard Edmond Joly, Moissy-Cramayel (FR); Romain Nicolas Lagarde, Moissy-Cramayel (FR); Jean-Marc Claude Perrollaz, Moissy-Cramayel (FR); Laurent Jablonski, Moissy-Cramayel (FR); François Jean Comin, Moissy-Cramayel (FR); Edouard Antoine Dominique Marie De Jaeghere, Moissy-Cramayel (FR); Charles Jean-Pierre Douguet, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 58 days.

(21) Appl. No.: 17/614,226

(22) PCT Filed: May 27, 2020

(86) PCT No.: PCT/EP2020/064645
§ 371 (c)(1),
(2) Date: Nov. 24, 2021

(87) PCT Pub. No.: WO2020/239803
PCT Pub. Date: Dec. 3, 2020

(65) Prior Publication Data

US 2022/0228491 A1 Jul. 21, 2022

(30) Foreign Application Priority Data

May 29, 2019 (FR) ..... 1905733
May 29, 2019 (FR) ..... 1905755

(51) Int. Cl.
*F01D 5/16* (2006.01)
*F01D 5/10* (2006.01)
(Continued)

(52) U.S. Cl.
CPC ..... *F01D 5/16* (2013.01); *F01D 5/10* (2013.01); *F01D 5/22* (2013.01); *F01D 5/26* (2013.01);
(Continued)

(58) Field of Classification Search
CPC ..... F01D 5/16; F01D 5/10; F01D 5/22; F01D 5/26; F01D 5/06; F05D 2230/30; F05D 2240/30; F05D 2260/96
See application file for complete search history.

(56) References Cited

U.S. PATENT DOCUMENTS 4,494,909 A * 1/1985 Forestier ..... F01D 11/008 416/193 A
4,723,889 A * 2/1988 Charreron ..... F01D 21/045 416/193 A
(Continued)

FOREIGN PATENT DOCUMENTS

CN 204941612 U 1/2016
EP 1985810 A1 10/2008
(Continued)

OTHER PUBLICATIONS

Yu, et al., A compresible Damping, Jan. 6, 2016, CPO, CN 204941612 (Year: 2016).*
(Continued)

*Primary Examiner* — Sabbir Hasan
*Assistant Examiner* — Joshua R Beebe
(74) *Attorney, Agent, or Firm* — Sughrue Mion, PLLC

(57) ABSTRACT

A turbomachine assembly includes a casing, first and second rotors, and a damper. The first rotor includes a disk and
(Continued)

blades and is movable in rotation relative to the casing. The second rotor is movable relative to the casing around a longitudinal axis. The damper damps a movement of the first rotor relative to the second rotor. The damper includes first to third parts. The first part bears on the first rotor in a first area extending over a first angular sector around the longitudinal axis and applies a first centrifugal force on the first rotor. The second part bears on the first rotor in a second area that is smaller than the first angular sector and extends over a second angular sector around the longitudinal axis. The third part bears on the second rotor and applies a second centrifugal force on the second rotor.

26 Claims, 17 Drawing Sheets

(51) Int. Cl.
*F01D 5/22* (2006.01)
*F01D 5/26* (2006.01)
*F01D 25/06* (2006.01)

(52) U.S. Cl.
CPC ..... *F01D 25/06* (2013.01); *F05D 2220/30* (2013.01); *F05D 2240/30* (2013.01); *F05D 2260/96* (2013.01)

(56) References Cited

U.S. PATENT DOCUMENTS 5,156,528 A * 10/1992 Bobo ..... F01D 5/22 416/193 A
5,820,346 A * 10/1998 Young ..... F01D 5/22 416/193 A
8,182,228 B2 * 5/2012 Riley ..... F01D 5/225 29/889.7
8,911,210 B2 * 12/2014 Bilz ..... F01D 5/3053 416/193 A
2009/0123286 A1 * 5/2009 Mace ..... F01D 5/22 416/193 A
2010/0135774 A1 * 6/2010 Dezouche ..... F01D 5/10 415/119

FOREIGN PATENT DOCUMENTS

FR 2923557 A1 5/2009
FR 2949142 A1 2/2011
FR 2970033 A1 7/2012
FR 3047512 A1 8/2017

OTHER PUBLICATIONS

Andre et al., Balancing and 'damping System of a Turbomachine Disc, Sep. 8, 1995, EPO, FR 2716931 A1 (Year: 1995).*
International Search Report dated Sep. 15, 2021 in International Application No. PCT/EP2020/064645.
Search Report dated Dec. 11, 2019 in French Application No. 1905733.
Search Report dated Dec. 11, 2019 in French Application No. 1905755.
Written Opinion of the International Searching Authority dated Sep. 15, 2021 in International Application No. PCT/EP2020/064645.

* cited by examiner

122

ASSEMBLY FOR TURBOMACHINE

CROSS REFERENCE TO RELATED APPLICATIONS

This application is a National Stage of International Application No. PCT/EP2020/064645, filed May 27, 2020, claiming priorities to French Patent Application Nos. 1905733 and 1905755, both filed May 29, 2019, the entire contents of each of the three applications being herein incorporated by reference in their entireties.

FIELD OF THE INVENTION

The present invention relates to an assembly for a turbomachine.

The invention relates more specifically to an assembly for a turbomachine comprising a damper.

STATE OF THE ART

A turbomachine known from the state of the art comprises a casing and a fan capable of being rotated relative to the casing, around a longitudinal axis, by means of a fan shaft.

The fan comprises a disk centered on the longitudinal axis, and a plurality of blades distributed circumferentially at the outer part of the disk.

The range of operation of the fan is limited. More specifically, the evolution of a compression rate of the fan as a function of an air flow rate it draws when rotated, is restricted to a predetermined range.

Beyond this range, the fan is indeed subjected to aeroelastic phenomena which destabilize it. More specifically, the air circulating through the running fan supplies energy to the blades, and the blades respond in their eigenmodes at levels that may exceed the endurance limit of the material constituting them. This fluid-structure coupling therefore generates vibrational instabilities which accelerate the wear of the fan and reduce its service life.

A fan which comprises a reduced number of blades, and which is subjected to high aerodynamic loads, is very sensitive to this type of phenomena.

This is the reason why it is necessary to guarantee a sufficient margin between the stable operating range and the areas of instability, so as to spare the endurance limits of the fan.

To do so, it is known practice to equip the fan with dampers. Examples of dampers have been described in documents FR 2 949 142, EP 1 985 810 and FR 2 923 557, in the name of the Applicant. These dampers are all configured to be housed between the platform and the root of each blade, within the housing delimited by the respective stilts of two successive blades.

Furthermore, such dampers operate during a relative movement between two successive blade platforms, by dissipation of the vibration energy, for example by friction. Consequently, these dampers focus only on damping a first vibratory mode of the blades which characterizes a synchronous response of the blades to the aerodynamic loads. In this first vibratory mode, the inter-blade phase-shift is non-zero.

However, such dampers are totally ineffective for damping a second vibratory mode in which each blade flaps relative to the disk with a zero inter-blade phase-shift. Indeed, in this second vibratory mode, there is no relative movement between two successive blade platforms. This particular response of the blades to the aerodynamic loads, although asynchronous, still involves a non-zero moment on the fan shaft. In addition, this second vibratory mode is coupled between the blades, the disk and the fan shaft. The amplitude of this second vibratory mode is all the more important as the blades are large.

There is therefore a need to overcome at least one of the drawbacks of the state of the art described above.

DISCLOSURE OF THE INVENTION

One aim of the invention is to damp a mode of vibration of a rotor in which the phase-shift between the blades of said rotor is zero.

Another aim of the invention is to influence the damping of modes of vibration of a rotor in which the phase-shift between the blades of said rotor is non-zero.

Another aim of the invention is to propose a damping solution which is simple and easy to implement.

To this end, according to a first aspect of the invention, an assembly for a turbomachine is proposed, comprising:

- a casing,
- a first rotor:
- movable in rotation relative to the casing around a longitudinal axis, and
- comprising:
- a disk, and
- a plurality of blades capable of flapping relative to the disk during a rotation of the first rotor relative to the casing,
- a second rotor movable in rotation relative to the casing around the longitudinal axis, and
- a damper configured to damp a movement of the first rotor relative to the second rotor, in a plane orthogonal to the longitudinal axis, the movement being caused by a flapping of at least one blade among the plurality of blades, the damper comprising:
- a first bearing part:
- bearing on the first rotor in a first bearing area extending over a first angular sector around the longitudinal axis,
- being configured to apply a first centrifugal force on the first rotor, and
- a second bearing part bearing on the first rotor in a second bearing area, different from the first bearing area, the second bearing area extending over a second angular sector around the longitudinal axis, the second angular sector being smaller than the first angular sector, and
- a third bearing part:
- bearing on the second rotor, and
- being configured to apply a second centrifugal force on the second rotor.

It is by damping a movement of the first rotor relative to the second rotor, in a plane orthogonal to the longitudinal axis, that it is possible to influence the second vibratory mode. Actually, unlike the first vibratory mode, the second vibratory mode is characterized by a zero inter-blade phase-shift. Consequently, placing a damper between two successive blades of a rotor, as it has already been proposed in the prior art, has no effect on the second vibratory mode. The damper of the assembly described above has, for its part, the advantage of influencing the second vibratory mode because it plays on an effect of the second vibratory mode: the movement of the first rotor relative to the second rotor, in the plane orthogonal to the longitudinal axis. By opposing this effect, the damper disrupts the cause thereof that is to say dampens the second vibratory mode. It should nevertheless be noted that the first vibratory mode also participates in the movement of the first rotor relative to the second rotor, in the plane orthogonal to the longitudinal axis. Consequently, by opposing this effect, the damper also participates in disrupting another cause thereof that is say damping the first vibratory mode. Furthermore, the second bearing part allows to improve the stability of the damper.

Advantageously, but optionally, the assembly according to the invention may further comprise one of the following characteristics, taken alone or in combination with one or several of the other of the following characteristics:

the first bearing part has a radially outer surface coming into contact with a radially inner surface of the first rotor, the third bearing part has a radially outer surface coming into contact with a radially inner surface of the second rotor, the first bearing part is fixedly mounted on the first rotor, the damper comprises a linking part:

connecting the first bearing part to the third bearing part, and being thinned relative to the first bearing part and to the third bearing part, in such an assembly:

the first bearing part has a first bearing surface arranged to apply a first force on the second rotor, the first force having a first longitudinal component in a first direction parallel to the longitudinal axis, and a first radial component in a second direction orthogonal to the longitudinal axis, the first longitudinal component being greater than the first radial component, the third bearing part has a second bearing surface arranged to apply a second force on the second rotor, the second force having a second longitudinal component in the first direction, and a second radial component in the second direction, the second radial component being greater than the second longitudinal component, it further comprises a sacrificial plate:

fixedly mounted on the third bearing part, and bearing on the second rotor, it further comprises:

a first sacrificial plate fixedly mounted on the first bearing part and having the first bearing surface, and a second sacrificial plate fixedly mounted on the third bearing part and having the second bearing surface, a slot is provided in the first bearing part, the assembly further comprising a metal insert inserted into the slot, the second sacrificial plate being fixedly mounted on the metal insert, the second bearing part is configured to apply a third centrifugal force on the first rotor, the second bearing part has a radially outer surface coming into contact with a radially inner surface of the first rotor, the damper comprises:

a second bearing part:

bearing on the first rotor in a second bearing area, different from the first bearing area, the second bearing area extending over a second angular sector around the longitudinal axis, the second angular sector being smaller than the first angular sector, and being configured to apply a third centrifugal force on the first rotor, and another second bearing part:

bearing on the first rotor in a third bearing area, different from the first bearing area and from the second bearing area, the third bearing area extending over a third angular sector around the longitudinal axis, the third angular sector being smaller than the first angular sector, and being configured to apply a fourth centrifugal force on the first rotor, each of the second bearing parts has a radially outer surface, coming into contact with a radially inner surface of the first rotor, at least one among the second bearing parts is fixedly mounted on the first rotor, at least one among the second bearing parts comprises a portion thinned relative to the rest of said second bearing part, at least one among the second bearing parts comprises a channel configured to promote a radial deformation of said second bearing part, the second bearing parts form lateral sections extending on either side, in a circumferential direction, of the first bearing part, it further comprises a flyweight fixedly mounted on the damper, the flyweight is fixedly mounted on the first bearing part, it further comprises a flyweight fixedly mounted on the third bearing part, it further comprises:

a first flyweight fixedly mounted on the first bearing part, and a second flyweight fixedly mounted on the third bearing part, each of the blades among the plurality of blades comprises:

a blade root connecting the blade to the disk, a profiled blading, a stilt connecting the blading to the blade root, and a platform connecting the blading to the stilt and extending transversely to the stilt, the first bearing part bearing on the platform of one blade among the plurality of blades, at least one among the second bearing area and the third bearing area extends along an entire axial length of the platform, and the second rotor comprises a shroud, the shroud comprising a circumferential extension, the third bearing part bearing on the circumferential extension.

According to a second aspect of the invention, there is proposed a turbomachine comprising an assembly as described above, and in which the first rotor is a fan and the second rotor is a low-pressure compressor.

DESCRIPTION OF THE FIGURES

Other characteristics, aims and advantages of the invention will emerge from the following description, which is purely illustrative and not limiting, and which should be read in relation to the appended drawings in which.

In all of the figures, the similar elements bear identical references

DETAILED DESCRIPTION OF THE INVENTION

Turbomachine 1

Figure 1:
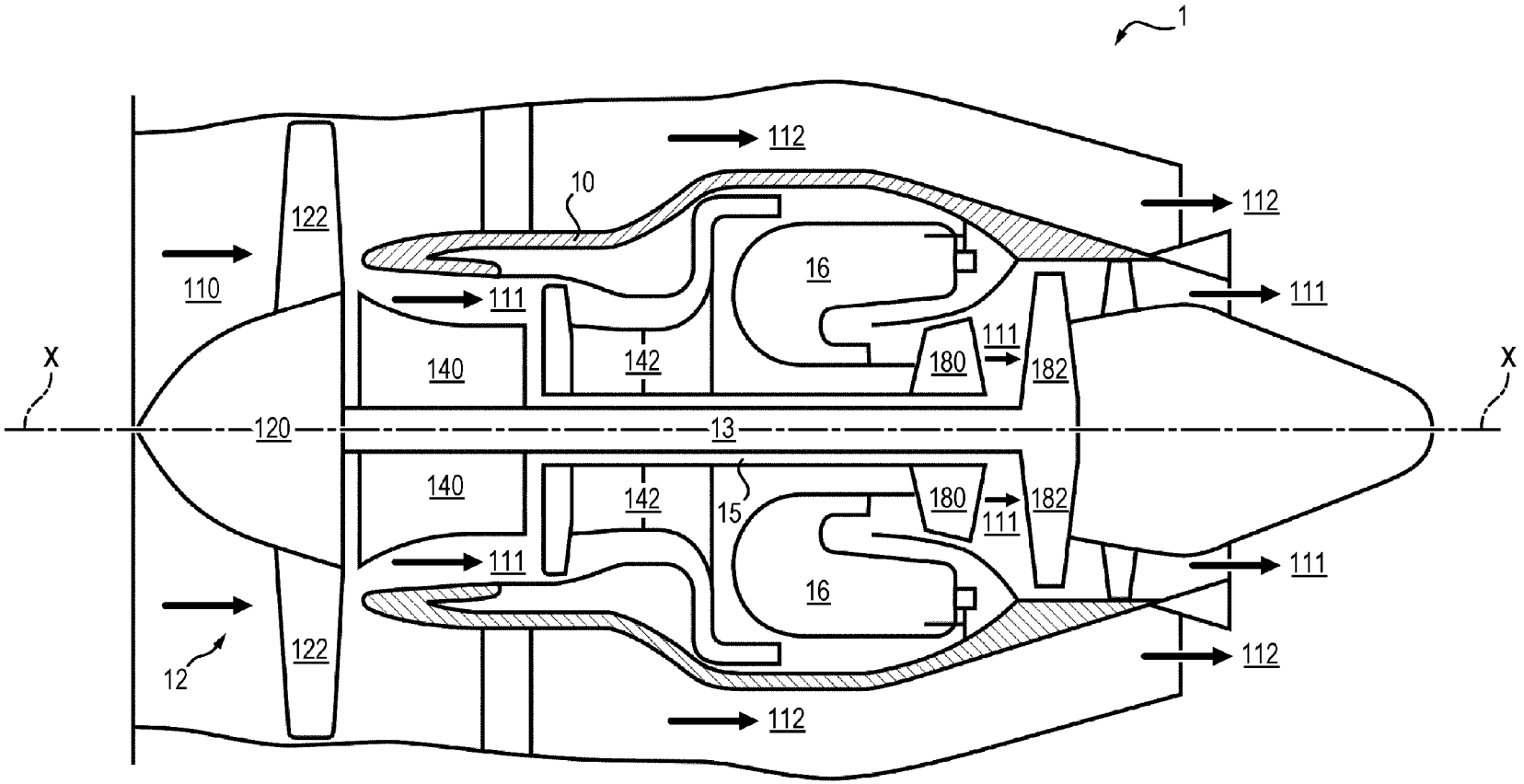
FIG. 1 schematically illustrates a turbomachine.

Referring to FIG. 1, a turbomachine 1 comprises a casing 10, a fan 12, a low-pressure compressor 140, a high-pressure compressor 142, a combustion chamber 16, a high-pressure turbine 180 and a low-pressure turbine 182.

Each of the fan 12, of the low-pressure compressor 140, of the high-pressure compressor 142, of the high-pressure turbine 180 and of the low-pressure turbine 182 is movable in rotation relative to the casing 10 around a longitudinal axis X-X.

Figure 2:
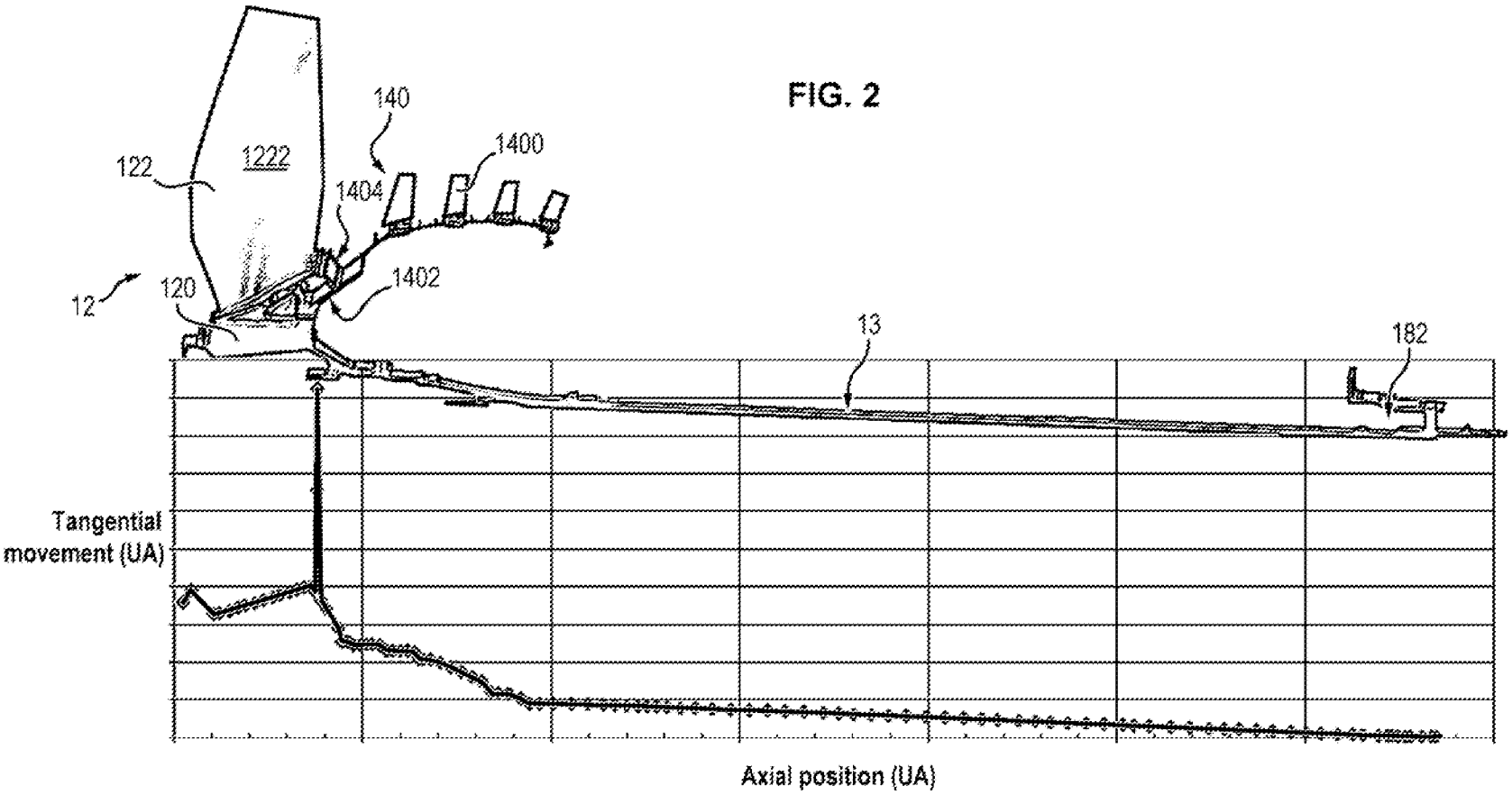
FIG. 2 comprises a sectional view of a part of a turbomachine, and a curve indicating a tangential movement of different elements of this turbomachine part as a function of the position of said elements along a longitudinal axis of the turbomachine.
Figure 3:
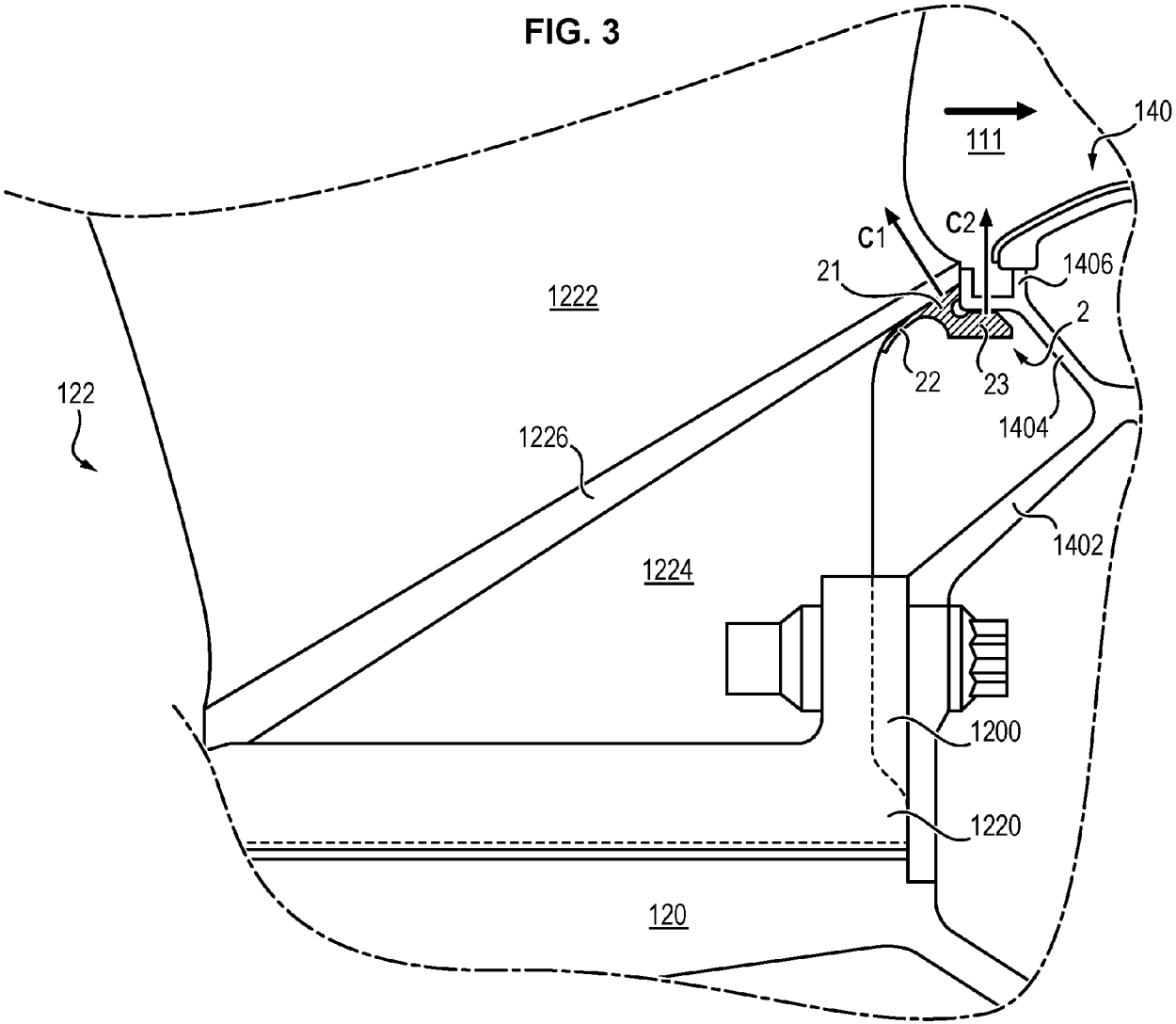
FIG. 3 is a sectional view of part of an exemplary embodiment of an assembly according to the invention.

In the embodiment illustrated in FIG. 1, and as also visible in FIGS. 2 and 3, the fan 12 and the low-pressure compressor 140 are secured in rotation and are capable of being rotated by a low-pressure shaft 13 which is itself capable of being rotated by the low-pressure turbine 182. The high-pressure compressor 142 is for its part capable of being rotated by a high-pressure shaft 15, which is itself capable of being rotated by the high-pressure turbine 180.

In operation, the fan 12 draws in an air stream 110 which separates between a secondary stream 112 circulating around the casing 10, and a primary stream 111 successively compressed within the low-pressure compressor 140 and the high-pressure compressor 142, ignited within the combustion chamber 16, then successively expanded within the high-pressure turbine 180 and the low-pressure turbine 182.

The upstream and the downstream are here defined relative to the direction of normal air flow 110, 111, 112 through the turbomachine 1. Likewise, an axial direction corresponds to the direction of the longitudinal axis X-X, a radial direction is a direction which is perpendicular to this longitudinal axis X-X and which passes through said longitudinal axis X-X, and a circumferential or tangential direction corresponds to the direction of a planar and closed curved line, all the points of which are at equal distance from the longitudinal axis X-X. Finally, and unless otherwise specified, the terms "inner (or internal)" and "outer (or external)", respectively, are used with reference to a radial direction such that the inner (i.e. radially inner) part or face of an element is closer to the longitudinal axis X-X than the outer (i.e. radially outer) part or face of the same element.

Fan 12 and Low-Pressure Compressor 140

Referring to FIGS. 1 to 3, the fan 12 comprises a disk 120 and a plurality of blades 122 circumferentially distributed at an outer part of the disk 120.

Referring to FIGS. 2 and 3, each of the blades 122 of the plurality of blades 122 comprises:

- a blade root 1220 connecting the blade 122 to the disk 120,
- a profiled blading 1222,
- a stilt 1224 connecting the blading 1222 to the blade root 1220, and
- a platform 1226 connecting the blading 1222 to the stilt 1224 and extending transversely to the stilt 1224.

The blade root 1220 may be integral with the disk 120 when the fan 12 is a one-piece bladed disk. Alternatively, as seen in FIG. 3, the blade root 1220 can be configured to be housed in a cell 1200 of the disk 120 provided for this purpose.

Figure 13:
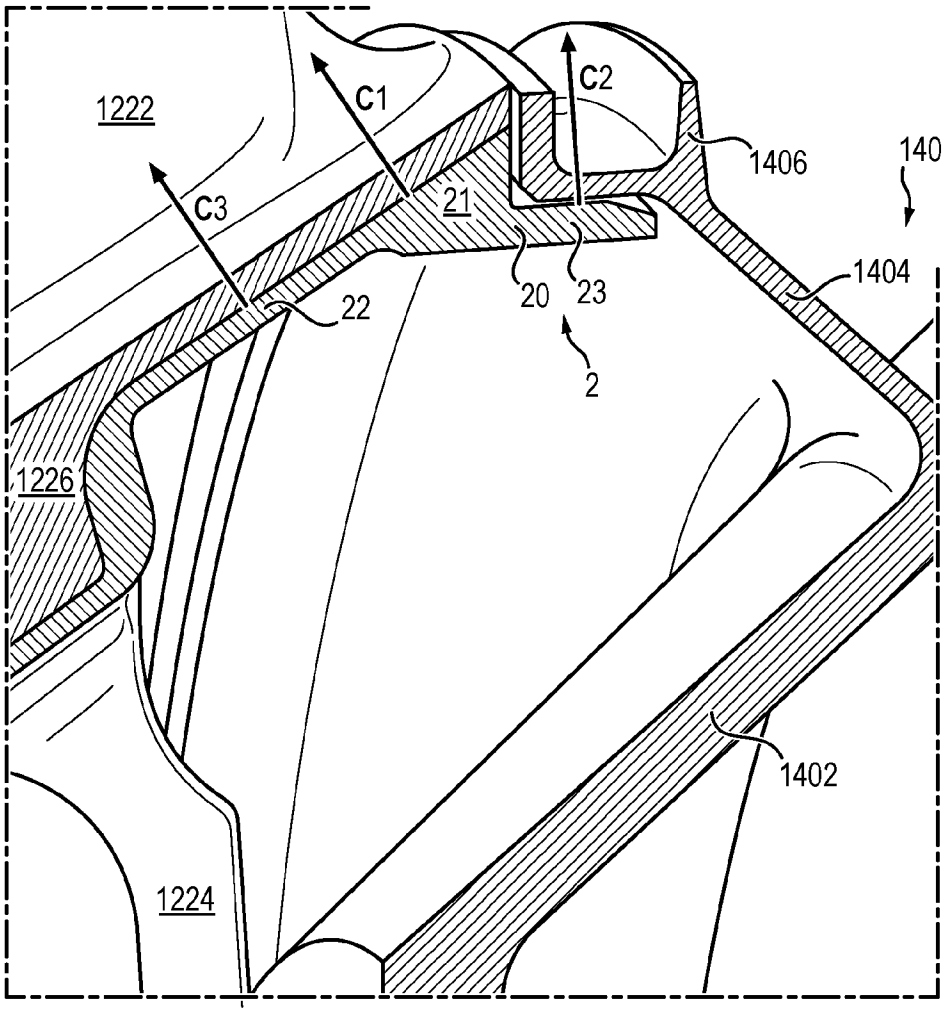
FIG. 13 is a perspective view of part of an exemplary embodiment of an assembly according to the invention.

As seen in FIGS. 2, 3 and 13, the low-pressure compressor 140 also comprises a plurality of blades 1400 fixedly mounted at an outer part of a shroud 1402, said shroud 1402 comprising a circumferential extension 1404 at the outer end from which radial sealing wipers 1406 extend. The radial sealing wipers 1406 face the platforms 1226 of the blades 122 of the fan 12, so as to guarantee the inner sealing of the flowpath within which the primary stream 111 circulates. As more specifically visible in FIG. 3, the shroud 1402 of the low-pressure compressor 140 is fixed to the disk 120 of the fan 12, for example by bolting.

Each of the blades 122 of the plurality of the blades 122 of the fan 12 is capable of flapping, by vibrating relative to the disk 120 during a rotation of the fan 12 relative to the casing 10. More specifically, during the coupling between the air 110 circulating within the fan 12 and the profiled bladings 1222, the blades 122 are the site of aeroelastic floating phenomena on different vibratory modes, and whose amplitude may be such that it exceeds the endurance limits of the materials constituting the fan 12. These vibratory modes are furthermore coupled to the opposite compressive forces upstream of the turbomachine 1, and to the expansion forces downstream of it.

A first vibratory mode characterizes a synchronous response of the blades 122 to the aerodynamic loads, in which the inter-blade phase-shift is non-zero.

A second vibratory mode characterizes an asynchronous response of the blades 122 to the aerodynamic loads, in which the inter-blade phase-shift is zero. The amplitude of the flapping of the second vibratory mode is moreover as large as the fan 12 blades 122 are large.

Furthermore, this second vibratory mode is coupled between the blades 122, the disk 120 and the fan shaft 13. The frequency of the second vibratory mode is in addition one and a half times greater than that of the first vibratory mode. Finally, the second vibratory mode has a nodal deformation at mid-height of the fan 12 blades 122.

In vibratory modes, including the second vibratory mode, the flapping of the blades 122 involves a non-zero moment on the low-pressure shaft 13. In particular, these vibratory modes cause intense torsional forces within the low-pressure shaft 13.

The vibrations induced by the flapping of the blades 122 of the fan 12, but also by the flapping of the blades 1400 of the low-pressure compressor 140, lead to significant relative tangential movements between the fan 12 and the low-pressure compressor 140. Indeed, the length of the blades 122 of the fan 12 is greater than the length of the blades 1400 of the low-pressure compressor 140. Consequently, the tangential bending moment caused by the flapping of a blade 122 of the fan 12 is greater than the tangential bending moment caused by flapping of a blade 1400 of the low-pressure compressor 140. The blading of the blades 122 of the fan 12 and of the blades 1400 of the low-pressure compressor 140 then have very different behaviors. Furthermore, the mounting stiffness within the fan 12 is different from the mounting stiffness within the low-pressure compressor 140.

As seen more specifically in FIG. 2, this results in particular in a large-amplitude movement of the fan 12 relative to the low-pressure compressor 140, in a plane orthogonal to the longitudinal axis X-X, at the interface between the platforms 1226 of the blades 122 of the fan 12 and the radial sealing wipers 1406 of the circumferential extension 1404 of the shroud 1402 of the low-pressure compressor 140. The amplitude of this movement for the second vibratory mode is for example between 0.01 and 0.09 millimeter, typically on the order of 0.06 millimeter, or, in another example, on the order of a few tenths of a millimeter, for example 0.1 or 0.2 or 0.3 millimeter.

Damper 2

A damper 2 is used to damp these vibrations of the fan 12 and/or of the low-pressure compressor 140.

The damper 2 is in particular configured to damp a movement of the fan 12 relative to the low-pressure compressor 140, in a plane orthogonal to the longitudinal axis X-X, the movement being caused by a flapping of at least one blade 122 among the plurality of blades 122 of the fan 12

Referring to FIGS. 3 to 17, the damper 2 comprises:

a first bearing part 21:

bearing on the fan 12 in a first bearing area extending over a first angular sector A1 around the longitudinal axis X-X, and being configured to apply a first centrifugal force C1 on the fan, and a second bearing part 22, 24 also bearing on the fan 12, but in a second bearing area, different from the first bearing area.

To apply the first centrifugal force C1, the first bearing part 21 has a radially outer surface, corresponding to the first bearing area, coming into contact with a radially inner surface of the fan 12, typically a radially inner surface of the platform 1226.

Figure 5:
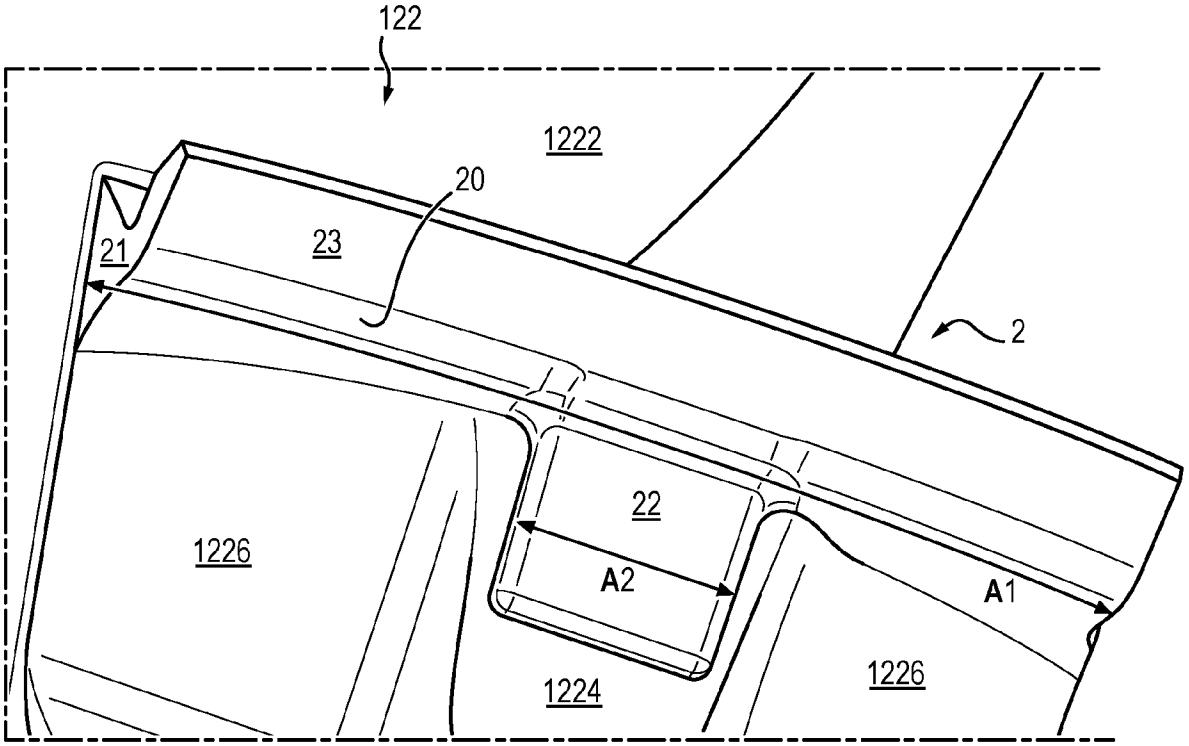
FIG. 5 is a perspective view of part of an exemplary embodiment of an assembly according to the invention.
Figure 12:
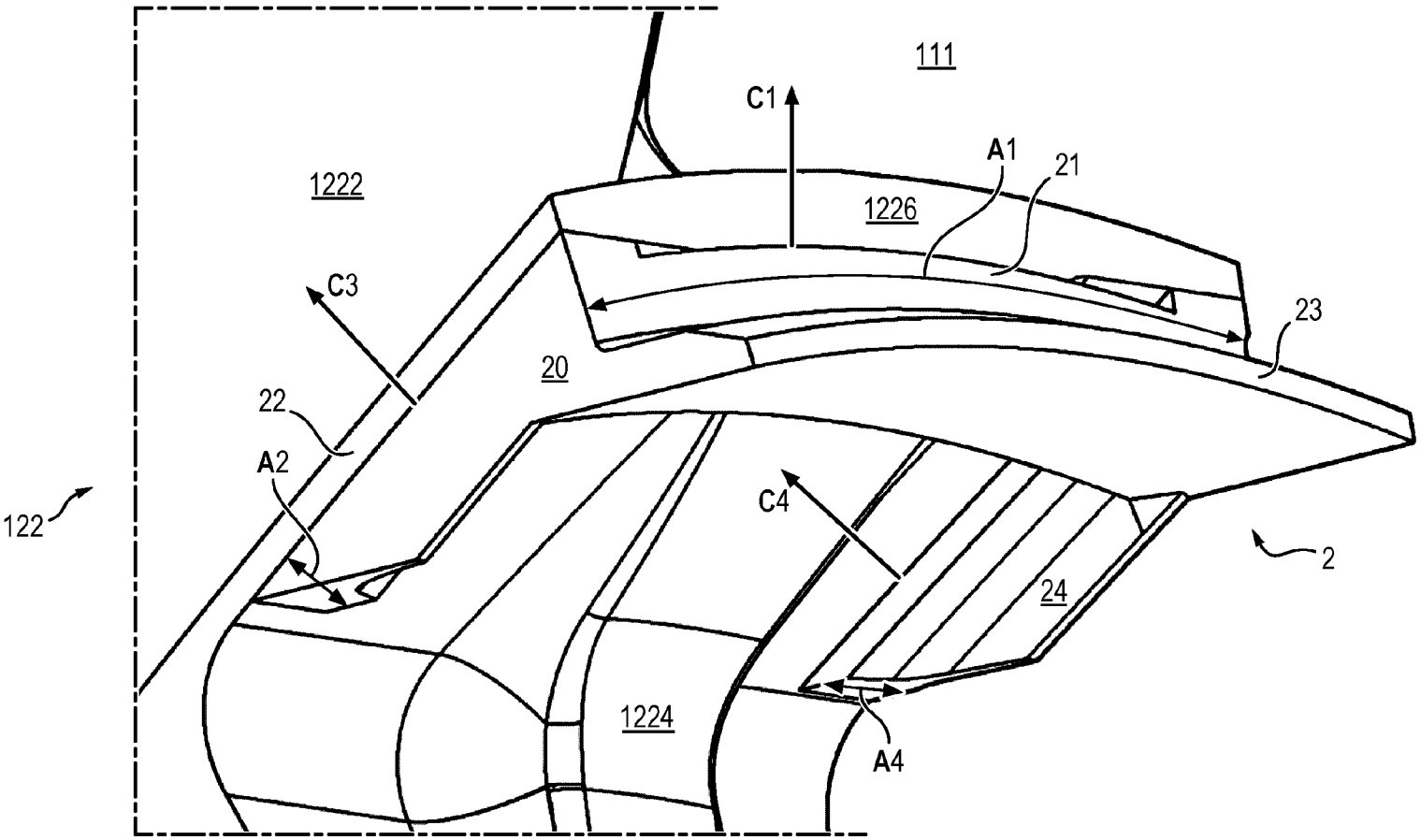
FIG. 12 is a perspective view of part of an exemplary embodiment of an assembly according to the invention.

As visible in particular in FIGS. 5 and 12, the second bearing area extends over a second angular sector A2, A4 around the longitudinal axis X-X, the second angular sector A2, A4 being smaller than the first angular sector A1.

All or part of the blades 122 of the fan 12 may moreover be equipped with such a damper 2, depending on the desired damping, but also the mounting and/or maintenance characteristics.

In one embodiment, the first bearing part 21 is fixedly mounted on the fan 12, for example by gluing. This facilitates the integration of the damper 2 within the turbomachine 1, and guarantees the bearing of the first bearing part 21 on the fan 12.

Advantageously, referring to FIGS. 4, 5, 12, 14, 16 and 17, the first angular sector A1 corresponds to the angular sector occupied by the platform 1226 of a blade 122 of the fan 12. In other words, the first bearing part 21 extends over the entire the circumferential dimension of the platform 1226 of the blade 122, at an inner surface of said platform 1226. The bearing of the damper 2 on the fan 12 is thus improved.

In one embodiment, the damper 2 comprises a material from the range having the trade name "SMACTANE® ST" and/or "SMACTANE® SP", for example a material of the type "SMACTANE® ST 70" and/or "SMACTANE® SP 50". It has indeed been observed that such materials have suitable damping properties.

Referring to FIGS. 3 to 17, in one embodiment, the damper 2 comprises a third bearing part 23:

bearing on the low-pressure compressor 140, and being configured to apply a second centrifugal force C2 on the low-pressure compressor 140.

In order to apply the second centrifugal force C2, the third bearing part 23 has a radially outer surface coming into contact with a radially inner surface of the low-pressure compressor 140, typically a radially inner surface of the circumferential extension 1404, for example a radially inner surface of the sealing wipers 1406.

Figure 4:
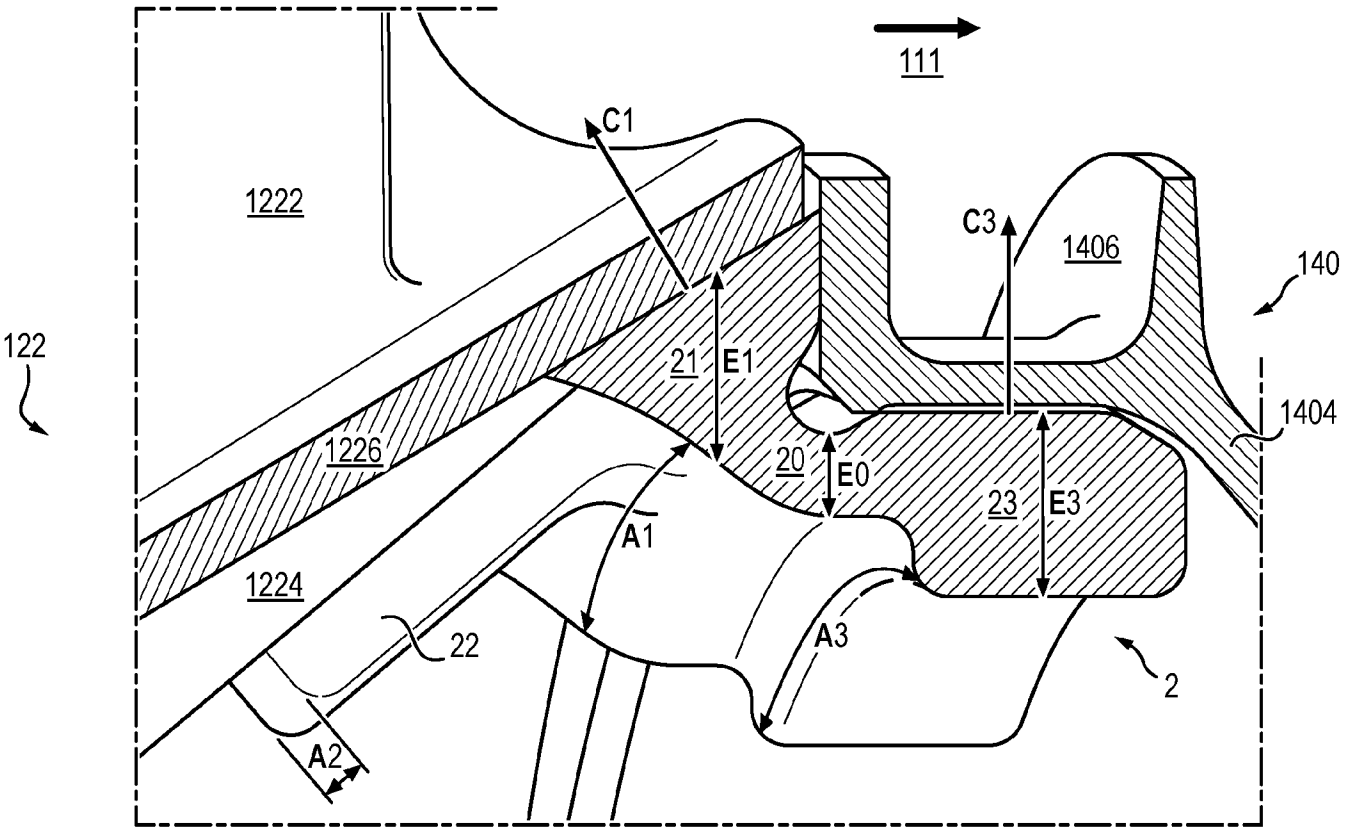
FIG. 4 is a perspective view of part of an exemplary embodiment of an assembly according to the invention.

As can be seen in FIG. 4, the third bearing part 23 bears on the low-pressure compressor 140 in a third bearing area extending over a third angular sector A3 around the longitudinal axis X-X.

Figure 10:
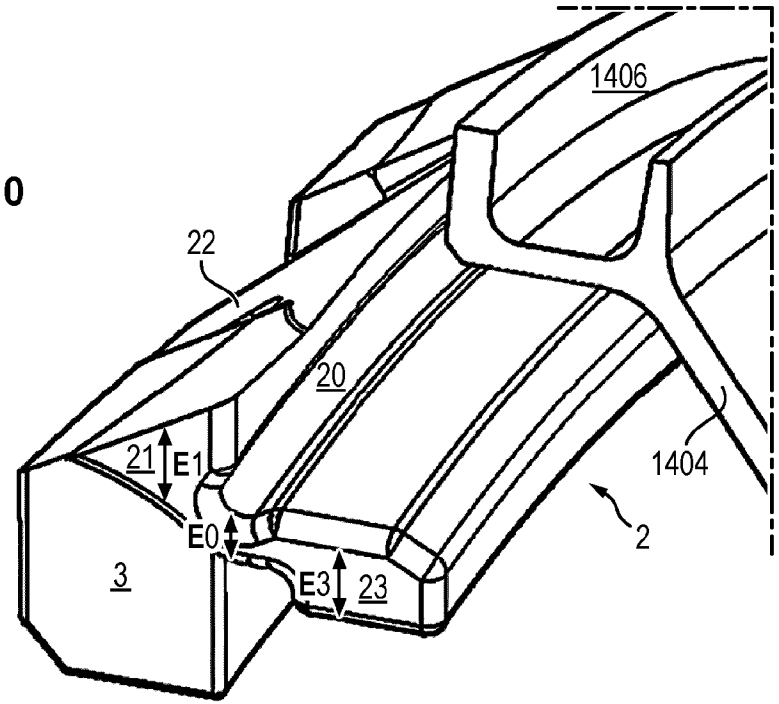
FIG. 10 is a perspective view of part of an exemplary embodiment of an assembly according to the invention.

Alternatively, as for example illustrated in FIG. 10, the third bearing part 23 is fixedly mounted on the low-pressure compressor 140, for example by gluing. The first bearing part 21 may then be mounted free to rub on the fan 12.

In an advantageous variant of this embodiment, for example illustrated in FIGS. 4, 6, 7, and 9 to 16, the damper 2 further comprises a linking part 20:

connecting the first bearing part 21 to the third bearing part 23, and being thinned relative to the first bearing part 21 and to the third bearing part 23.

More specifically, as illustrated in FIGS. 4, 6, 7, and 9 to 11, the first bearing part 21 has a first radial thickness E1 in a section plane which comprises the longitudinal axis X-X, the third bearing part 23 has a third radial thickness E3 in the section plane, and the linking part 20 has a radial linking thickness E0 in the section plane. FIG. 3 provides an example of a view in such a section plane. As can be seen in FIGS. 4, 6, 7, and 9 to 11, the radial linking thickness E0 is smaller than the first radial thickness E1 and, than the third radial thickness E3. The linking part 20 is therefore thinned with respect to the first bearing part 21 and to the third bearing part 23.

Thus, the first bearing part 21 and the third bearing part 23 are massive. Consequently, in operation, each of the first bearing part 21 and the third bearing part 23 exerts a respective centrifugal force C1, C2 on the fan 12 and the low-pressure compressor 140, on which bear said bearing parts 21, 23. In this way, the bearing parts 21, 23 are each dynamically coupled respectively to a fan 12 and to the low-pressure compressor 140 on which each bears, so as to undergo the same vibrations as each of the fan 12 and the low-pressure compressor 140. Furthermore, the bearing parts 21, 23 are stiffer than the linking part 20, in particular in a tangential direction. Advantageously, as for example visible in FIG. 4, the third radial thickness E3 is greater than the first radial thickness E1, so as to better guarantee the bearing of the third bearing part 23.

The thinner linking part 20 is more flexible, in particular in a tangential direction. Therefore, it allows the fan 12 to transmit the vibrations to which it is subject to the low-pressure compressor 140 and, conversely, it allows the low-pressure compressor 140 to transmit the vibrations to which it is subject to the fan 12. Indeed, for high vibration frequencies, damping is provided in particular by the shear operation of the linking part 20, that is to say by viscoelastic dissipation. For low vibration frequencies, damping is in particular ensured by friction of either one of the first bearing part 21 or of the third bearing part 23 respectively against the fan 12 or against the low-pressure compressor 140.

Furthermore, the third bearing part 23 bears on the circumferential extension 1404 of the shroud 1402 of the low-pressure compressor 140, at an inner surface of the radial sealing wipers 1406. Indeed, it is in this position that the movement of the fan 12 relative to the low-pressure compressor 140, in the plane orthogonal to the longitudinal axis X-X, is of greater amplitude, typically a few millimeters. Consequently, the damper 2 is particularly effective there. Furthermore, the thinning of the linking part 20 ensures a clearance which allows the damper 2 to avoid to rub on one corner of the radial sealing wipers 1406.

In one embodiment, for example illustrated in FIGS. 12, 13, 15 and 17, the second bearing part 22, 24 is configured to apply a third centrifugal force C3, C4 to the fan 12. For this purpose, the second bearing part 22, 24 has a radially outer surface coming into contact with a radially inner surface of the fan 12. In an advantageous variant, the second bearing part 22 further bears on a downstream surface of the stilt 1224 of the blade 122, as visible in FIGS. 4 and 5. In another variant, illustrated in FIGS. 12 to 17, the second bearing part 22, 24 bears under the platform 1226 of a blade 122 of the fan 12, at an inner surface of the platform 1226.

Figure 6:
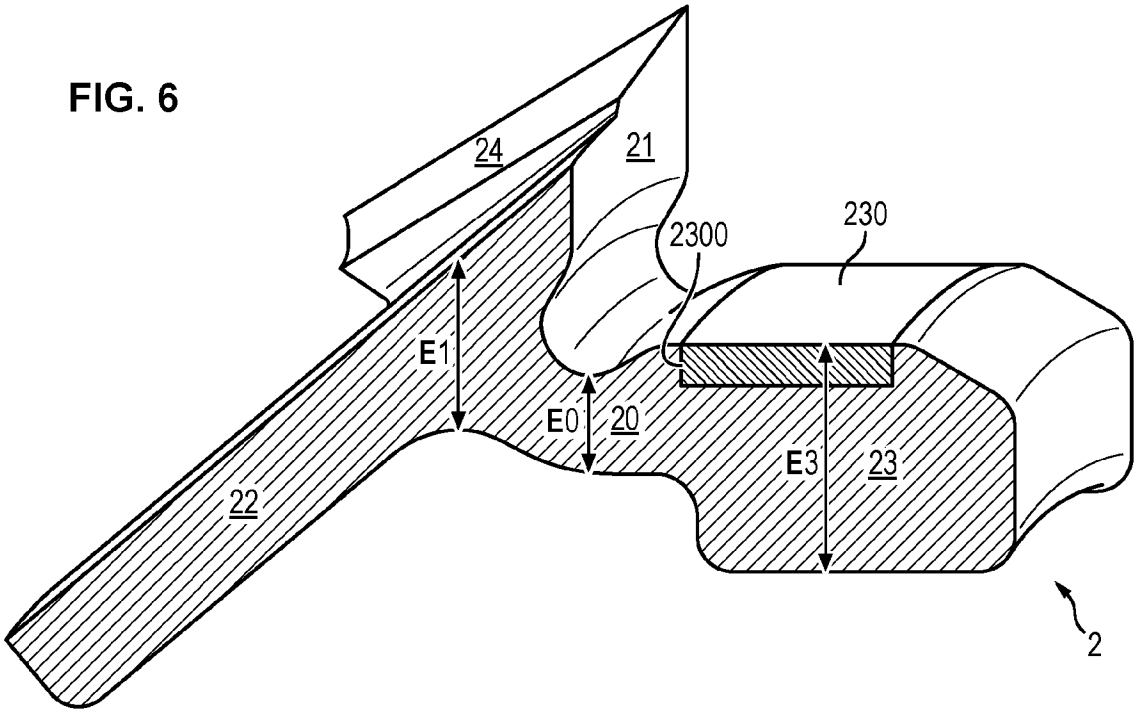
FIG. 6 is a perspective view of a damper of an exemplary embodiment of an assembly according to the invention.

Referring to FIG. 6, in one embodiment, a sacrificial plate 230 bears on the low-pressure compressor 140. The sacrificial plate 230 is fixedly mounted on the third bearing part 23, for example by gluing, and/or by being housed within a groove 2300 of the third bearing part 23 provided for this purpose, as shown in FIG. 6. The sacrificial plate 230 is configured to guarantee the bearing of the third bearing part 23 on the low-pressure compressor 140. Indeed, the mechanical stresses in operation are such that slight tangential, axial and radial movements of the damper 2 are to be expected. These movements are in particular due to the vibrations to be damped, but also to the centrifugal loading of the damper 2. It is necessary that these movements do not wear out the low-pressure compressor 140. In this regard, the sacrificial plate 230 comprises an anti-wear material, for example of the teflon type and/or any type of composite material. In an advantageous configuration, the sacrificial plate 230 is further treated by dry lubrication, in order to perpetuate the value of the coefficient of friction between the damper 2 and the low-pressure compressor 140. This material with lubricating properties is for example of the MoS2 type.

Advantageously, the sacrificial plate 230 may also comprise an additional coating, configured to reduce the friction and/or wear of the low-pressure compressor 140. This additional coating is fixedly mounted on the sacrificial plate 230, for example by gluing. The additional coating is of the dissipative and/or viscoelastic and/or damping type. It may indeed comprise a material from the range having the trade name "SMACTANE® ST" and/or "SMACTANE® SP", for example a material of the type "SMACTANE® ST 70" and/or "SMACTANE® SP 50". It may also comprise a material chosen from those having mechanical properties similar to those of Vespel, Teflon or any other material with lubricating properties. More generally, the additional coating material advantageously has a coefficient of friction between 0.3 and 0.07. The sacrificial plate 230 is optionally combined by juxtaposition with its additional coating. Indeed, it allows to increase the friction, in particular tangential friction, of the damper 2 when, in operation, the sacrificial plate 230 is sufficiently constrained by the second centrifugal force C2 so that the movement of the fan 12 with respect to the low-pressure compressor 140, in the plane orthogonal to the longitudinal axis X-X, is damped by energy dissipation by means of a viscoelastic shear of the sacrificial plate 230.

Figure 7:
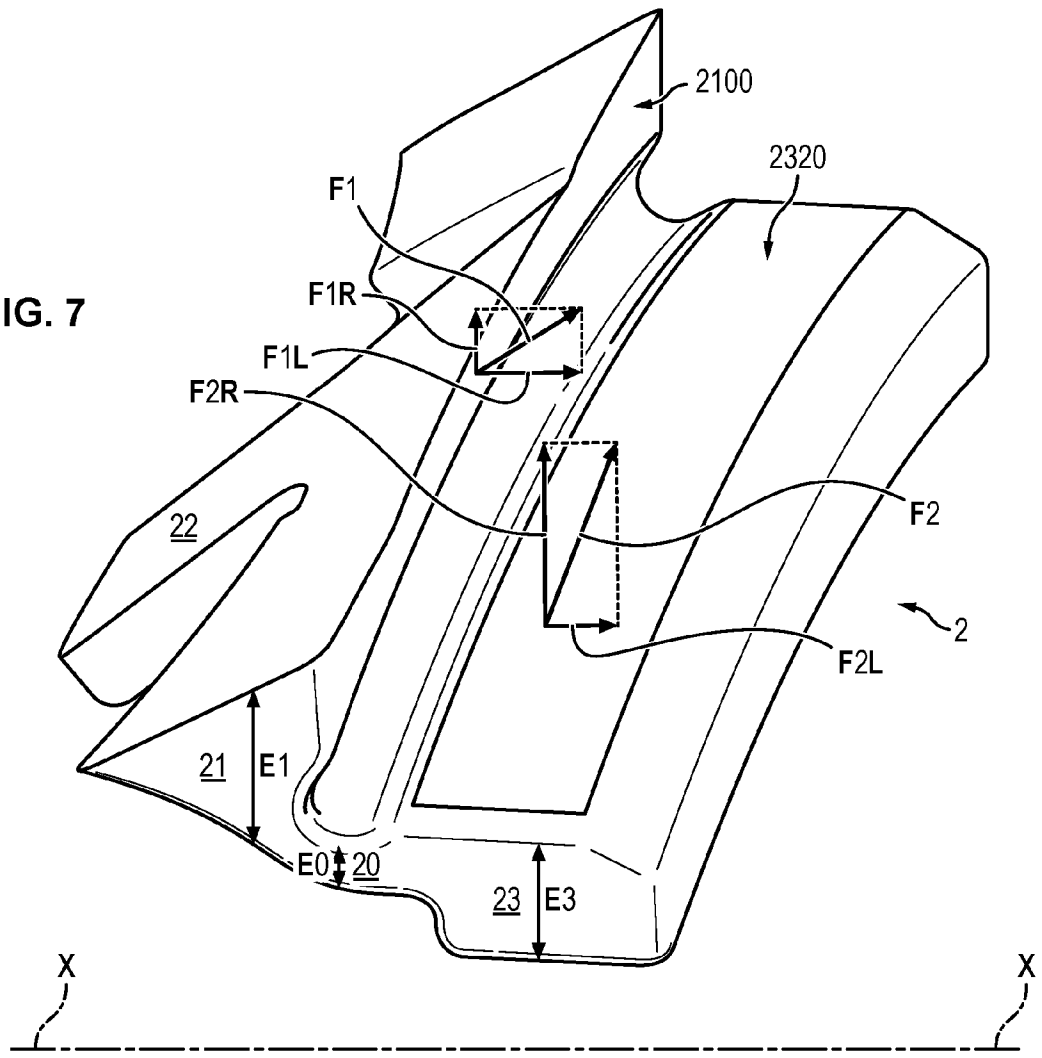
FIG. 7 is a perspective view of a damper of an exemplary embodiment of an assembly according to the invention.
Figure 16:
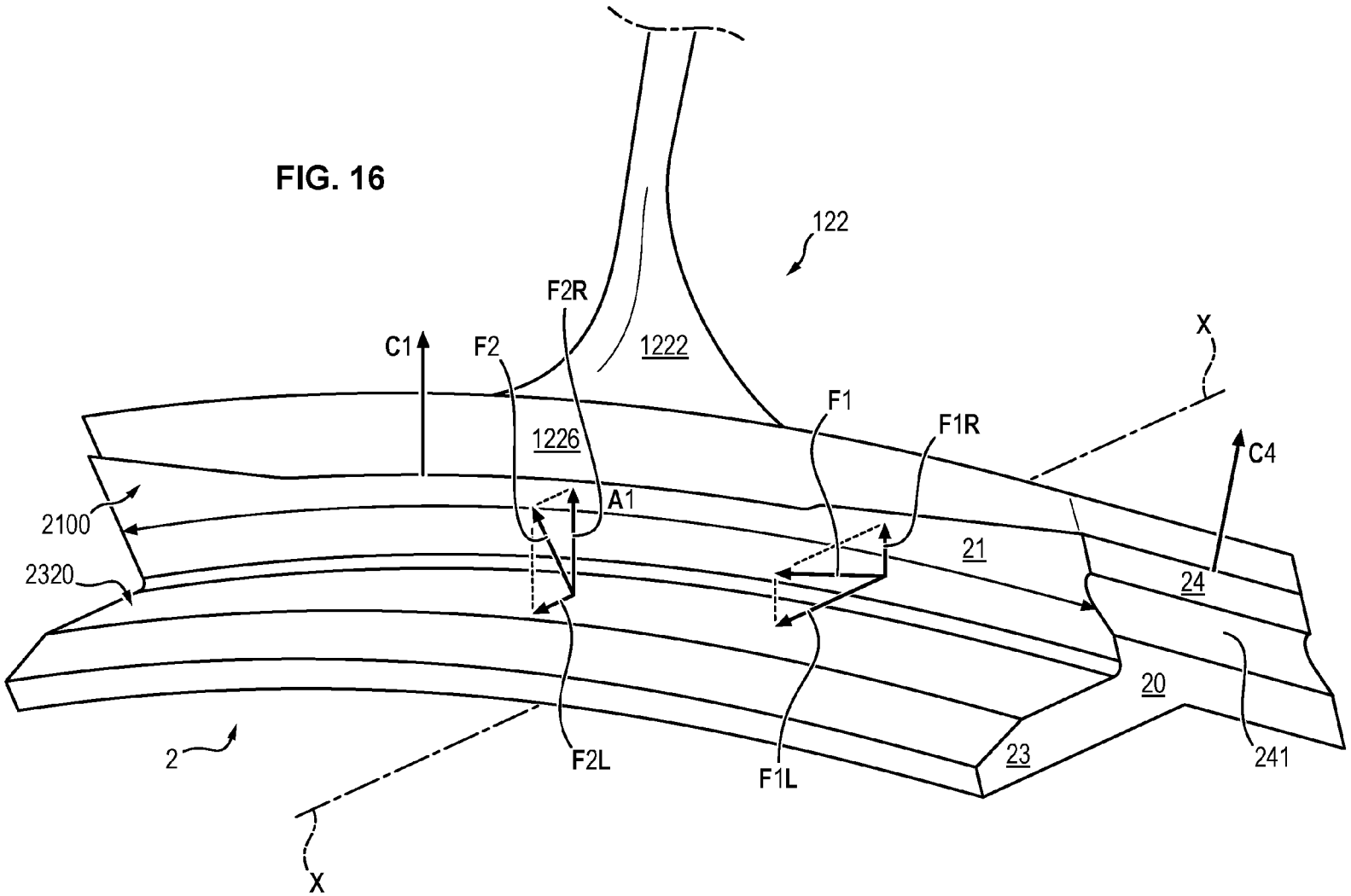
FIG. 16 is a perspective view of part of an exemplary embodiment of an assembly according to the invention.

Referring to FIGS. 7 and 16, in one embodiment:

- the first bearing part 21 has a first bearing surface 2100 arranged to apply a first force F1 on the low-pressure compressor 140, the first force F1 having a first longitudinal component F1L in a first direction parallel to the longitudinal axis X-X, and a first radial component F1R in a second direction orthogonal to the longitudinal axis X-X, the first longitudinal component F1L being greater than the first radial component F1R,
- the third bearing part 23 has a second bearing surface 2320 arranged to apply a second force F2 on the low-pressure compressor 140, the second force F2 having a second longitudinal component F2L in the first direction, and a second radial component F2R in the second direction, the second radial component F2R being greater than the second longitudinal component F2L.

In other words, the first bearing surface 2100 ensures the axially positioned bearing of the damper 2 since it is a downstream axial surface of the damper 2 coming into contact with an upstream axial surface of the low-pressure compressor 140. Furthermore, the second bearing surface 2320 ensures the radially positioned bearing of the damper 2 since it is a radially outer surface of the damper 2 coming into contact with a radially inner surface of the low-pressure compressor 140. In addition, in operation, the second bearing surface 2320 participates in the application of the second centrifugal force C2 on the low-pressure compressor 140.

Figure 8:
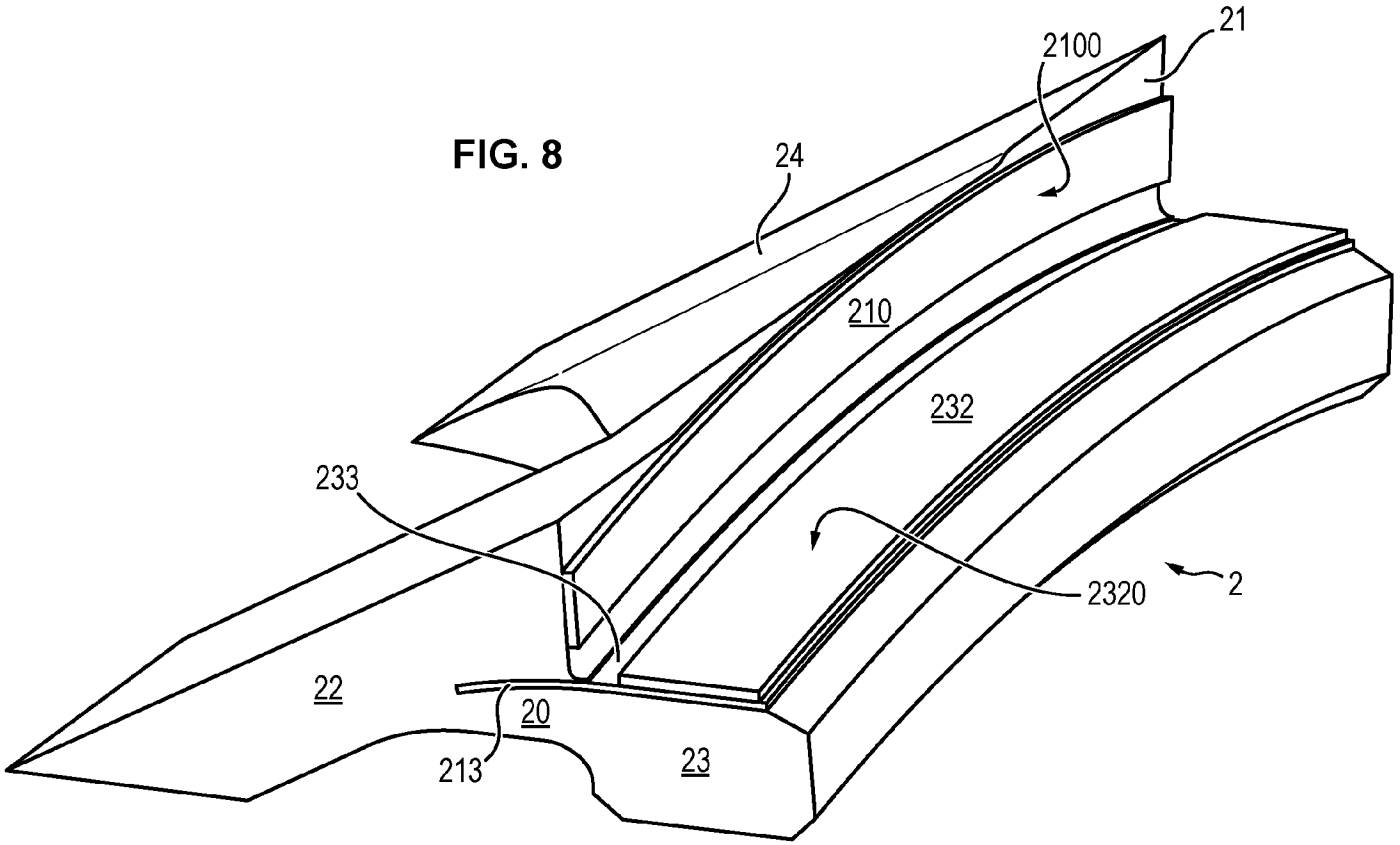
FIG. 8 is a perspective view of a damper of an exemplary embodiment of an assembly according to the invention.

Referring to FIG. 8, in an advantageous variant of the embodiment illustrated in FIGS. 7 and 16:

- a first sacrificial plate 210 is fixedly mounted on the first bearing part 21, for example by gluing, and has the first bearing surface 2100, and
- a second sacrificial plate 232 is fixedly mounted on the third bearing part 23, for example by gluing, and has the second bearing surface 2320.

The first sacrificial plate 210 and the second sacrificial plate 232 advantageously have the same characteristics as those described with reference to the sacrificial plate 230 of the embodiment illustrated in FIG. 6, with the same benefits for the damping of a movement of the fan 12 with respect to the low-pressure compressor 140, in the plane orthogonal to the longitudinal axis X-X.

Still with reference to FIG. 8, also advantageously, a slot 213 is formed in the first bearing part 21, a metal insert 233 being inserted into the slot 213, the second sacrificial plate 232 being fixedly mounted on the metal insert 233, for example by gluing. The metal insert 233 allows to stiffen the damper 2. Furthermore, the metal insert 233 facilitates the deformation of the first sacrificial plate 210 and of the second sacrificial plate 232.

Figure 9:
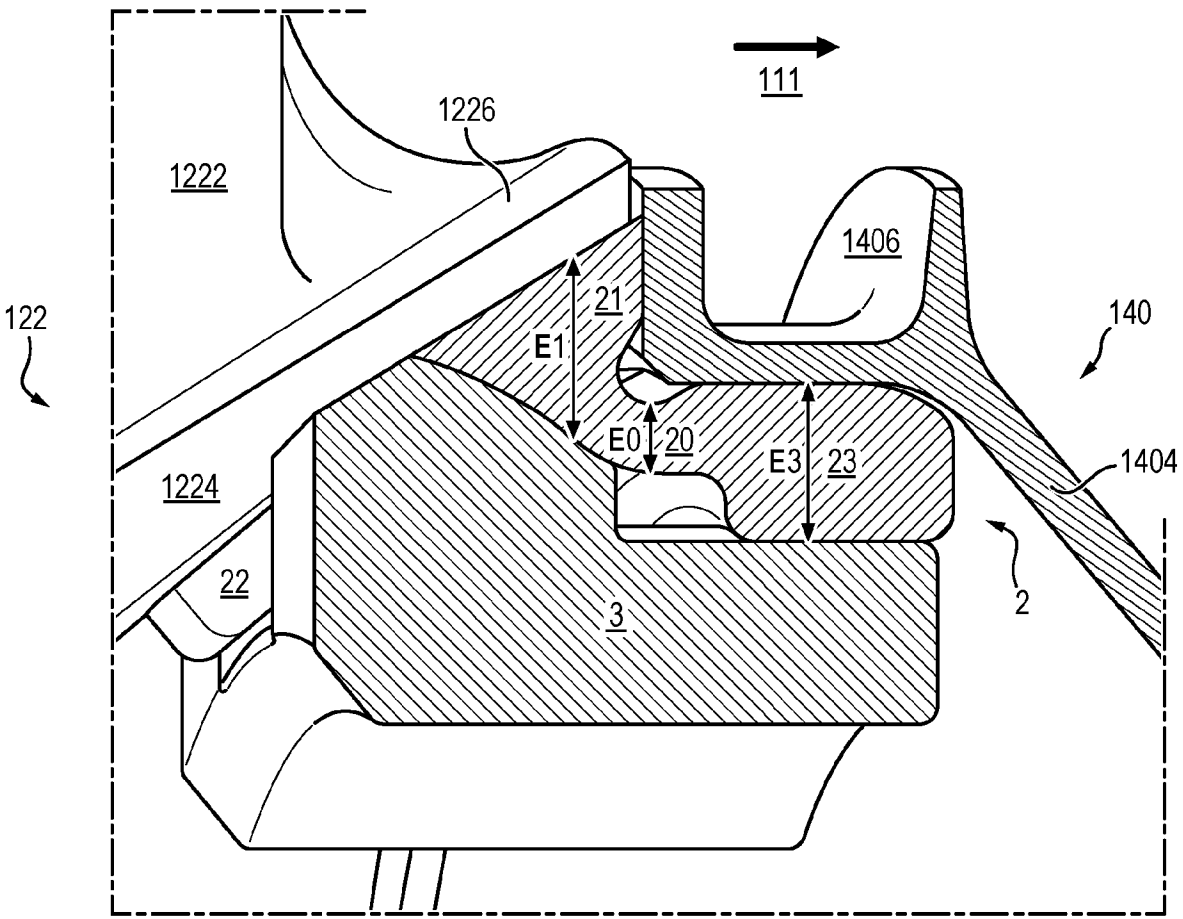
FIG. 9 is a perspective view of part of an exemplary embodiment of an assembly according to the invention.
Figure 11:
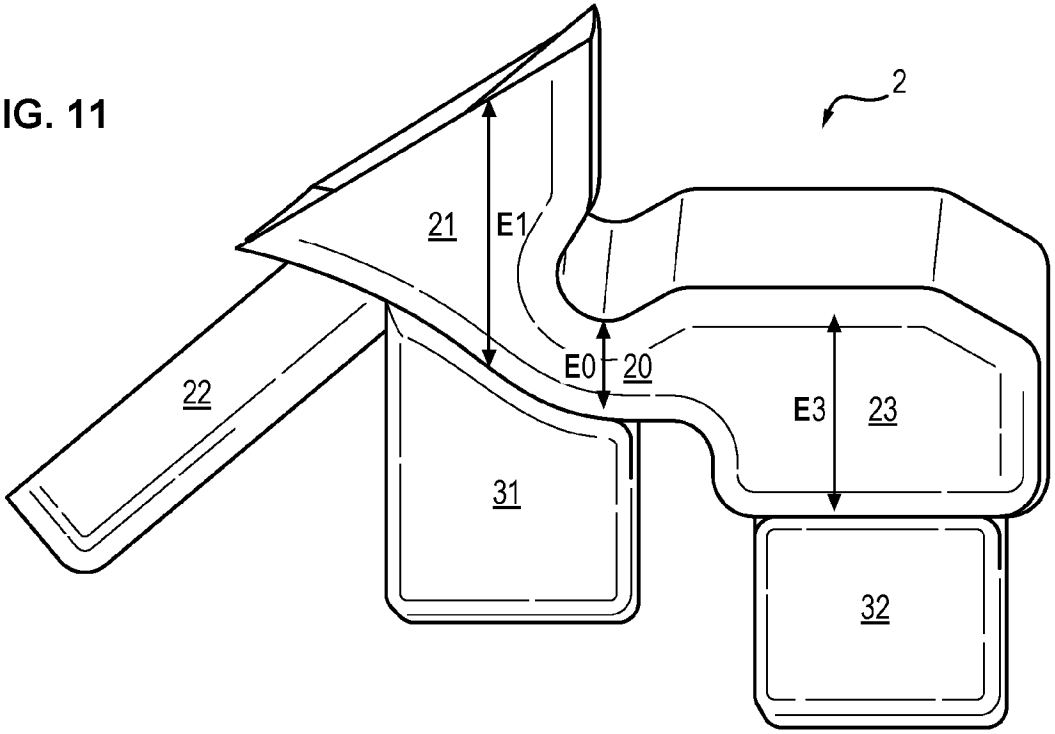
FIG. 11 is a perspective view of a damper of an exemplary embodiment of an assembly according to the invention.

With reference to FIGS. 9 to 11, in one embodiment, a flyweight 3 is fixedly mounted on the damper 2, for example by gluing. The flyweight 3 allows to adjust the centrifugal forces C1, C2, C3, C4 exerted by the damper 2 on the fan 12 and on the low-pressure compressor 140, so as to improve the dynamic coupling between the first bearing part 21 and the fan 12, and between the third bearing part 23 and the low-pressure compressor 140. Advantageously, the flyweight 3 comprises an elastomeric material. With reference to FIG. 9, the flyweight 3 may then be fixedly mounted both on the first bearing part 21 and on the third bearing part 23, for example by gluing.

Referring to FIG. 10, in an advantageous variant, the flyweight 3 is fixedly mounted on the first bearing part 21, for example by gluing, preferably only on the first bearing part 21. Advantageously, as can be seen in FIG. 10, the flyweight is offset upstream of the first bearing part 21, so as to leave the linking part 20 free so that, in operation, it can effectively operate in shear mode to damp a movement of the fan 12 with respect to the low-pressure compressor 140, in a plane orthogonal to the longitudinal axis X-X. Alternatively, the flyweight 3 is fixedly mounted on the third bearing part 23, for example by gluing, preferably only on the third bearing part 23. Advantageously, and for the same reasons as those mentioned with reference to the first bearing part 21, the flyweight 3 is offset downstream from the third bearing part 23. Preferably, the flyweight 3 is fixedly mounted only on the first bearing part 21 if the third bearing part 23 is fixedly mounted on the low-pressure compressor 140.

In another advantageous variant, with reference to FIG. 11:

- a first flyweight 31 is fixedly mounted on the first bearing part 21, for example by gluing, and
- a second flyweight 32 is fixedly mounted on the third bearing part 23.

In this way, it is possible to independently adjust the first centrifugal force C1 and the second centrifugal force C2. This improves the damping of vibrations by targeting the vibration modes specific to the fan 12 and specific to the low-pressure compressor 140.

With reference to FIGS. 12 to 17, in one embodiment, the damper 2 comprises:

- a second bearing part 22:
- bearing on the fan 12 in a second bearing area, different from the first bearing area, the second bearing area extending over a second angular sector A2 around the longitudinal axis X-X, the second angular sector A2 being smaller than the first angular sector A1, and
- being configured to apply a third centrifugal force C3 to the fan 12, and
- another second bearing part 24:
- bearing on the fan 12 in a third bearing area, different from the first bearing area and from the second bearing area, the third bearing area extending over a third angular sector A4 around the longitudinal axis X-X, the third angular sector A4 being smaller than the first angular sector A1, and
- being configured to apply a fourth centrifugal force C4 to the fan 12.

To apply the third centrifugal force C3, and the fourth centrifugal force C4, each of the second bearing parts 22, 24 has a radially outer surface, coming into contact with a radially inner surface of the fan 12, typically a radially inner surface of the platform 1226.

As visible in FIGS. 12 to 17, the two second bearing parts 22, 24 form lateral sections extending on either side, in a circumferential direction, of the first bearing part 21. Thus, the two second bearing parts 22, 24 promote coupling with the fan 12, and the damping of a movement of the fan 12 relative to the low-pressure compressor 140, by increasing the overall stiffness of the first bearing part 21. Moreover, the rigidity of the first bearing part 21 is increased at its circumferential ends. The damping of the damper 2, in particular in a tangential direction, is then generally improved.

In an advantageous variant of this embodiment, at least one among the first bearing part 21 and the two second bearing parts 22, 24, is fixedly mounted on the fan 12, for example by gluing. This facilitates the integration of the damper 2 within the turbomachine 1, and guarantees the bearing of said bearing parts 21, 22, 24 on the fan 12.

In an equally advantageous variant, as can be seen in FIGS. 12, 13, 14, 16 and 17, each of the first bearing part 21, and the two second bearing parts 22, 24 bears on the blade platform 122 of the fan 12, at an inner surface of the platform 1226.

Figure 14:
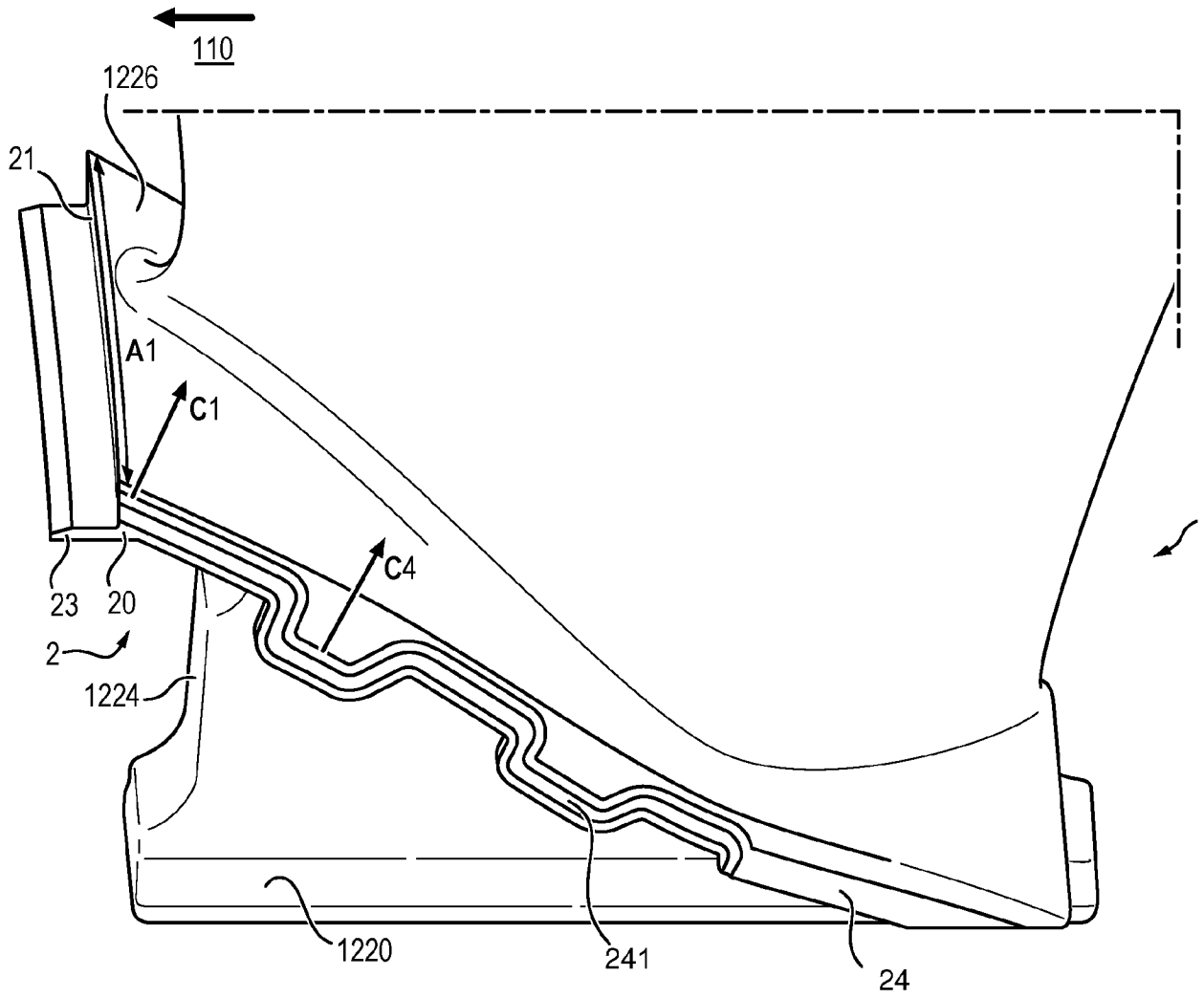
FIG. 14 is a perspective view of part of an exemplary embodiment of an assembly according to the invention.
Figure 17:
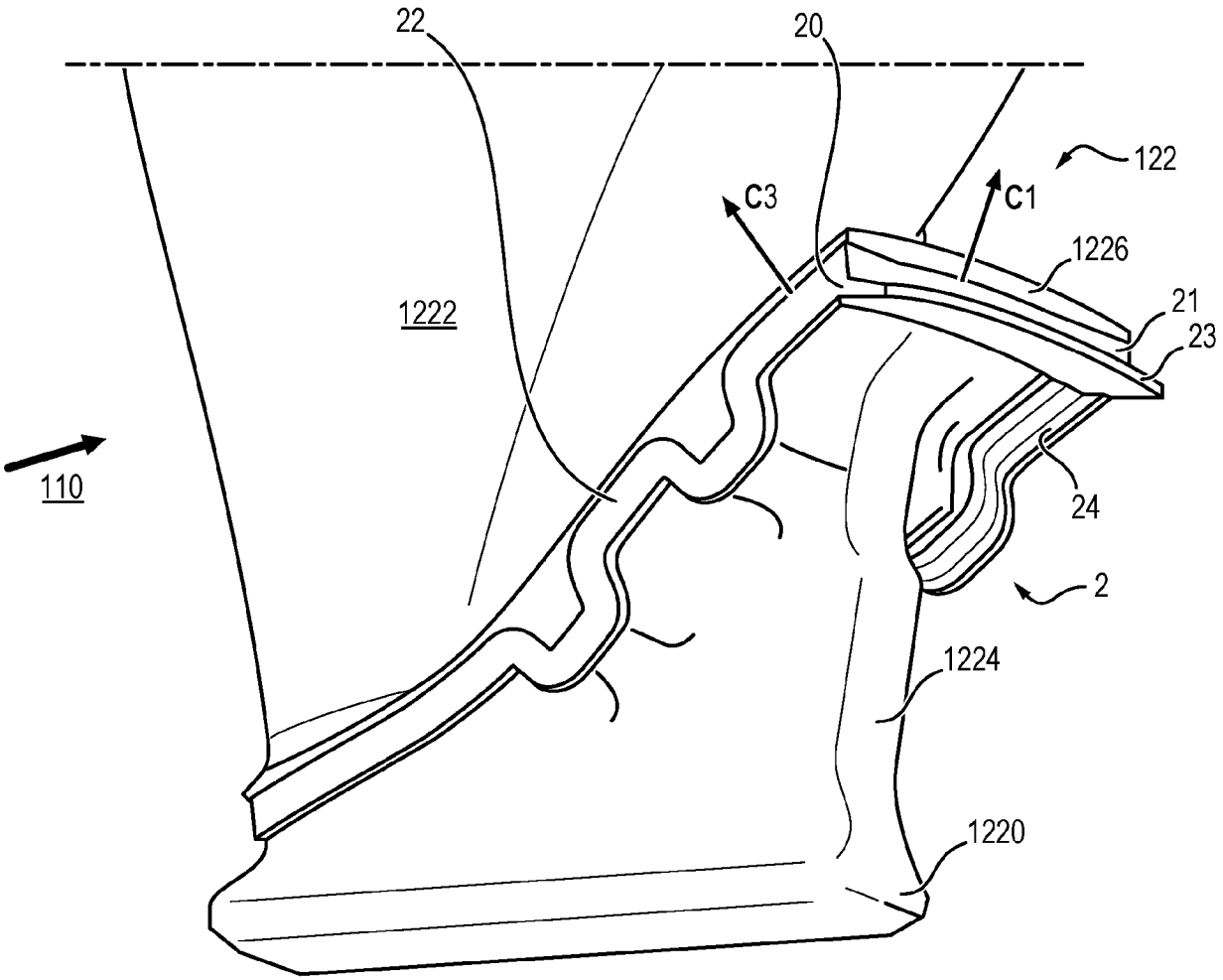
FIG. 17 is a perspective view of part of an exemplary embodiment of an assembly according to the invention.

With reference to FIGS. 14 and 17, in a variant of this embodiment, at least one among the two second bearing areas 22, 24 extends along an entire axial length of the platform 1226. In other words, at least one among the two second parts 22, 24 extends all along the platform 1226. Advantageously, as also visible in FIGS. 14 and 17, at least one among the two second bearing parts 22, 24 is flush with one edge of the platform 1226. In other words, a radial surface of the platform 1226 at a circumferential end of said platform 1226 is extended by a radial surface of the second bearing part 22, 24 at a circumferential end of said second bearing part 22, 24 which corresponds to the circumferential end of the platform 1226. In this way, the second bearing parts 22, 24 of the circumferentially adjacent dampers 2 within the fan 12 bear against each other. This participates in the damping by friction of the vibrations of the fan 12. Furthermore, these bearings of the second bearing parts 22, 24 of the dampers 2 circumferentially adjacent to one another improve the sealing of the air flowpath 110. In an advantageous variant, for example illustrated in FIG. 17, only one among the second bearing parts 22, 24 extends all along the platform 1226, flush with one edge of the platform 1226, while the other among the second bearing parts 22, 24 extends only along a portion of the platform 1226. Thus, only the second bearing part 22, 24 which is the longest axially participates in the sealing while the other participates rather in damping.

Figure 15:
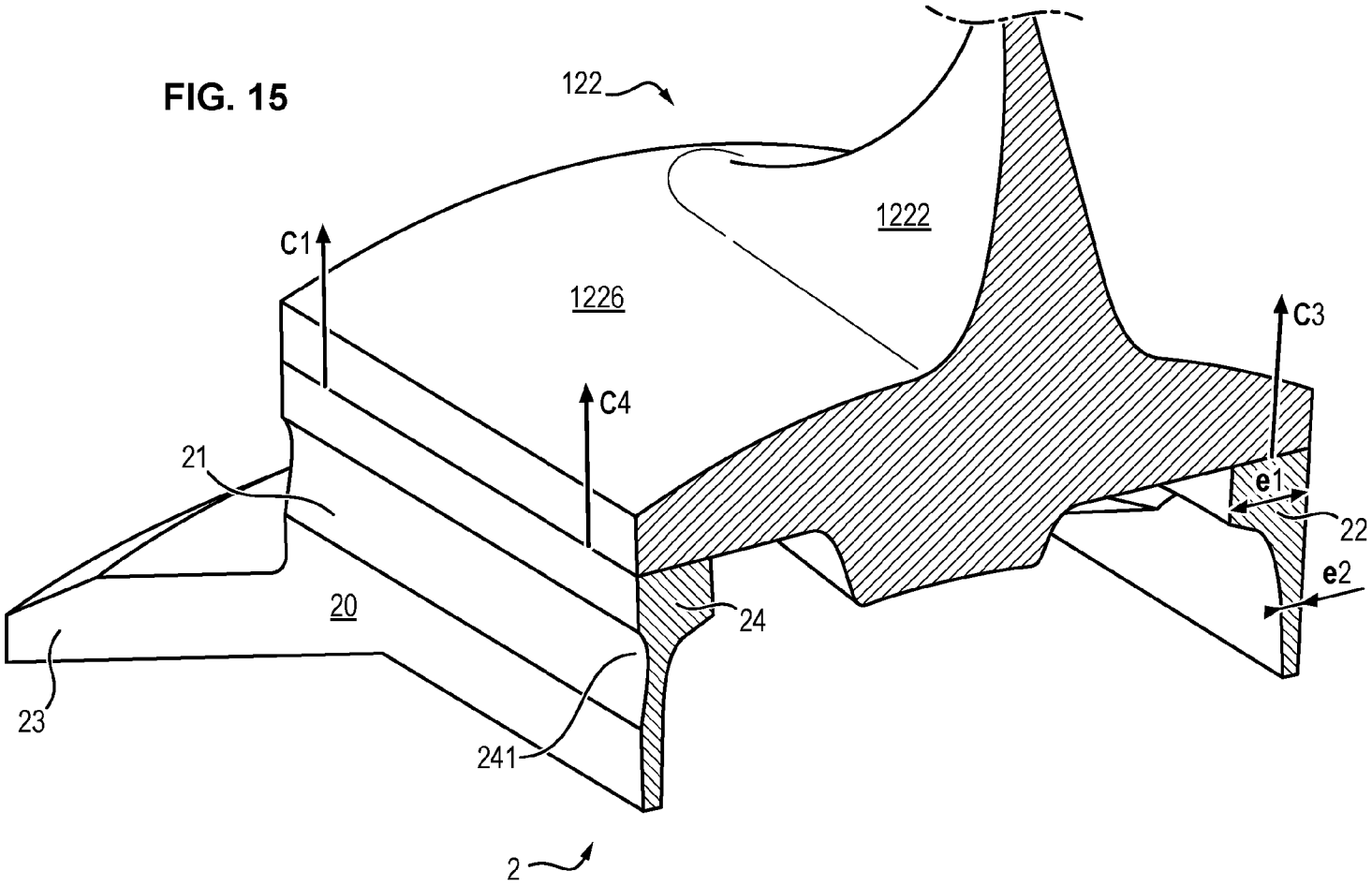
FIG. 15 is a perspective view of a section of part of an exemplary embodiment of an assembly according to the invention.

With reference to FIG. 15, in another variant of this embodiment, at least one among the second bearing parts 22, 24 comprises a portion thinned relative to the rest of said second bearing part 22, 24. More specifically, as visible in FIG. 15, a first circumferential thickness e1 of the second bearing part 22, 24 is different from a second circumferential thickness e2 of the second bearing part 22, 24, said second circumferential thickness e2 being taken at a radial position different from a radial position of the first circumferential thickness e1. Advantageously, as visible in FIG. 15, at least one among the second bearing parts 22, 24 is thicker at an inner surface of the platform 1226 than at a distance from the inner surface distance of the platform 1226. This allows to stiffen said second bearing part 22, 24 in order to promote the application of the corresponding centrifugal force C3, C4 to the fan 12. Furthermore, the presence of the first circumferential thickness e1 facilitates the holding, for example by gluing, of the second bearing part 22, 24 on the inner surface of the platform 1226. Finally, the presence of the second circumferential thickness e2 improves the sealing between the second bearing parts 22, 24 which are circumferentially adjacent.

Still with reference to FIG. 15, but as also visible in FIGS. 14 and 16, in an advantageous variant of this embodiment, at least one among the second bearing parts 22, 24 comprises a channel 241. The channel 241 is configured to promote a radial deformation of said second bearing part 22, 24 during the application of the corresponding centrifugal force C3, C4. This in particular promotes the sealing between the platforms 1226 of the successive blades 122 of the fan 12.

In this embodiment, it can also be seen that the bearing parts 21, 22, 23, 24 are massive. Consequently, in operation, each of the first bearing parts 21, 22, 23, 24 exerts a respective centrifugal force C1, C2, C3, C4 on the fan 12 and the low-pressure compressor 140, on which bear said bearing parts 21, 22, 23, 24. In this way, the bearing parts 21, 22, 23, 24 are each dynamically coupled respectively to a fan 12 and to the low-pressure compressor 140 on which each bears, so as to undergo the same vibrations as each of the fan 12 and the low-pressure compressor 140. Furthermore, in the variant of this embodiment where the damper 2 comprises a linking part 20, the bearing parts 21, 22, 23, 24 are stiffer than the linking part 20, in particular in a tangential direction.

In all that has been described above, the damper 2 is configured to damp a movement of the fan 12 relative to the low-pressure compressor 140, in the plane orthogonal to the longitudinal axis X-X.

This is however not limiting, since the damper 2 is also configured to damp a movement of any first rotor 12 relative to any second rotor 140, in a plane orthogonal to the longitudinal axis X-X, as long as the first rotor 12 is movable in rotation relative to the casing 10 around the longitudinal axis X-X and comprises a disk 120 as well as a plurality of blades 122 capable of flapping by vibrating relative to the disk 120 during a rotation of the first rotor 12 relative to the casing 10, and as the second rotor 140 is also movable in rotation relative to the casing 10 around the longitudinal axis X-X.

Thus, the first rotor 12 can be a first stage of the high-pressure compressor 142 or of the low-pressure compressor 140, and the second rotor 140 can be a second stage of said compressor 140, 142, successive to the first stage of compressor 140, 142, upstream or downstream thereof. Alternatively, the first rotor 12 can be a first stage of a high-pressure turbine 180 or of low-pressure turbine 182, and the second rotor 140 can be a second stage of said turbine 180, 182, successive to the first stage of turbine 180, 182, upstream or downstream thereof.

In any event, the damper 2 has a small space requirement. Consequently, it can be easily integrated into the existing turbomachines.

In addition, by being configured to exert centrifugal forces C1, C2, C3, C4 on the first rotor 12 and, optionally, on the second rotor 140, the damper 2 ensures a significant tangential stiffness between the first rotor 12 and the second rotor 140. It thus differs from an excessively flexible damper which would only deform during a movement of the first rotor 12 relative to the second rotor 140, in the plane orthogonal to the longitudinal axis X-X. On the contrary, the damper 2 dissipates such a movement:

- either by friction and/or oscillations between a state where the damper 2 is bonded on the rotors 12, 140 and a state where the damper 2 slides on the rotors 12, 140, which allows damping in particular the low frequencies,
- or by viscoelastic shear within the damper 2, which allows damping in particular the high frequencies.

However, the damper 2 remains flexible enough to maximize the contact surfaces between said damper 2 and the rotors 12, 140 on which it bears. To do so, the damper 2 has a tangential rigidity greater than an axial rigidity and a radial rigidity.

The contact forces between the damper 2 and the rotors 12, 140 can in particular be adjusted by means of flyweights 3 and/or sacrificial plates 230, 210, 232 and/or additional coatings on said sacrificial plates 230, 210, 232. At low frequencies, it is indeed necessary to ensure that the centrifugal forces C1, C2, C3, C4 exerted by the damper 2 on the rotors 12, 140 are not too large, in order to guarantee that the damper 2 can oscillate between a bonded state and a slippery state on the rotors 12, 140, and thus damp by friction. At high frequencies, on the other hand, it is necessary to ensure that the centrifugal forces C1, C2, C3, C4 exerted by the damper 2 on the rotors 12, 140 are sufficiently large for the pre-stress of the damper 2 on the rotors 12, 140 to be sufficient, in order to ensure that the damper 2 can be the viscoelastic shear seat.

The wear of the rotors 12, 140 is in particular limited by the treatment of the surfaces of the damper 2 bearing on the rotors 12, 140, for example to equip them with a coating with a low coefficient of friction.

The invention claimed is:

1. A turbomachine assembly comprising:

a casing;

a first rotor comprising a disk and a plurality of blades, the first rotor being movable in rotation relative to the casing around a longitudinal axis;

a second rotor movable in rotation relative to the casing around the longitudinal axis; and a damper configured to damp a movement of the first rotor relative to the second rotor in a plane orthogonal to the longitudinal axis, the movement being caused by a flapping of at least one of the plurality of blades relative to the disk, the damper comprising:

a first part bearing on the first rotor in a first area extending over a first angular sector around the longitudinal axis and being configured to apply a first centrifugal force on the first rotor;

a second part bearing on the first rotor in a second area different from the first area, the second area extending over a second angular sector around the longitudinal axis, the second angular sector being smaller than the first angular sector;

a third part bearing on the second rotor and being configured to apply a second centrifugal force on the second rotor; and a fourth part bearing on the first rotor in a third area different from the first area and from the second area, the third area extending over a third angular sector around the longitudinal axis, the third angular sector being smaller than the first angular sector;

wherein the second part and the fourth part form lateral sections extending on either side of the first part in a circumferential direction.

2. The turbomachine assembly of claim 1, wherein the first part has a radially outer surface coming into contact with a radially inner surface of the first rotor.

3. The turbomachine assembly of claim 1, wherein the third part has a radially outer surface coming into contact with a radially inner surface of the second rotor.

4. The turbomachine assembly of claim 1, wherein the first part is fixedly mounted on the first rotor.

5. The turbomachine assembly of claim 1, wherein the damper comprises a linking part connecting the first part to the third part and being thinned relative to the first part and to the third part.

6. The turbomachine assembly of claim 1, wherein:

the first part has a first surface arranged to apply a first force on the second rotor, the first force having a first longitudinal component in a first direction parallel to the longitudinal, and a first radial component in a second direction orthogonal to the longitudinal axis, the first longitudinal component being greater than the first radial component; and the third part has a second surface arranged to apply a second force to the second rotor, the second force having a second longitudinal component in the first direction and a second radial component in the second direction, the second radial component being greater than the second longitudinal component.

7. The turbomachine assembly of claim 6, further comprising:

a first plate fixedly mounted on the first part and having the first surface; and a second plate fixedly mounted on the third part and having the second surface.

8. The turbomachine assembly of claim 7, wherein a slot is formed in the first part, the turbomachine assembly further comprising a metal insert inserted into the slot, the second plate being fixedly mounted on the metal insert.

9. The turbomachine assembly of claim 1, further comprising a plate fixedly mounted on the third part and bearing on the second rotor.

10. The turbomachine assembly of claim 1, wherein the second part is configured to apply a third centrifugal force on the first rotor.

11. The turbomachine assembly of claim 10, wherein the second part has a radially outer surface coming into contact with a radially inner surface of the first rotor.

12. The turbomachine assembly of claim 1, wherein the second part is configured to apply a third centrifugal force on the first rotor and the fourth part is configured to apply a fourth centrifugal force on the first rotor.

13. The turbomachine assembly of claim 1, wherein each of the second part and of the fourth part has a radially outer surface coming into contact with a radially inner surface of the first rotor.

14. The turbomachine assembly of claim 1, wherein at least one of the second part and of the fourth part is fixedly mounted on the first rotor.

15. The turbomachine assembly of claim 1, wherein at least one of the second part and of the fourth part comprises a portion thinned relative to the rest of the at least one of the second part and of the fourth part.

16. The turbomachine assembly of claim 1, wherein at least one of the second part and of the fourth part comprises a channel configured to promote a radial deformation of the at least one of the second part and of the fourth part.

17. The turbomachine assembly of claim 1, further comprising a flyweight fixedly mounted on the damper.

18. The turbomachine assembly of claim 17, wherein the flyweight is fixedly mounted on the first part.

19. The turbomachine assembly of claim 1, further comprising a flyweight fixedly mounted on the third part.

20. The turbomachine assembly of claim 1, further comprising:

a first flyweight fixedly mounted on the first part; and a second flyweight fixedly mounted on the third part.

21. The turbomachine assembly of claim 1, wherein each of the plurality of blades comprises:

a blade root connecting the blade to the disk;

a profiled blading;

a stilt connecting the profiled blading to the blade root; and a platform connecting the profiled blading to the stilt and extending transversely to the stilt, the first part bearing on the platform of one of the plurality of blades.

22. The turbomachine assembly of claim 21, wherein second part is configured to apply a third centrifugal force on the first rotor and the fourth part is configured to apply a fourth centrifugal force on the first rotor; and wherein at least one of the second area and the third area extends along an entire axial length of the platform.

23. The turbomachine assembly of claim 1, wherein the second rotor comprises a shroud, the shroud comprising a circumferential extension, the third part bearing on the circumferential extension.

24. A turbomachine comprising the turbomachine assembly of claim 1, and wherein the first rotor is a fan and the second rotor is a low—pressure compressor.

25. A turbomachine assembly comprising:

a casing;

a first rotor comprising a disk and a plurality of blades, the first rotor being movable in rotation relative to the casing around a longitudinal axis;

a second rotor movable in rotation relative to the casing around the longitudinal axis; and a damper configured to damp a movement of the first rotor relative to the second rotor in a plane orthogonal to the longitudinal axis, the movement being caused by a flapping of at least one of the plurality of blades relative to the disk, the damper comprising:

a first part bearing on the first rotor in a first area extending over a first angular sector around the longitudinal axis and being configured to apply a first centrifugal force on the first rotor;

a second part bearing on the first rotor in a second area different from the first area, the second area extending over a second angular sector around the longitudinal axis, the second angular sector being smaller than the first angular sector; and a third part bearing on the second rotor and being configured to apply a second centrifugal force on the second rotor;

wherein:

the first part has a first surface arranged to apply a first force on the second rotor, the first force having a first longitudinal component in a first direction parallel to the longitudinal, and a first radial component in a second direction orthogonal to the longitudinal axis, the first longitudinal component being greater than the first radial component; and the third part has a second surface arranged to apply a second force to the second rotor, the second force having a second longitudinal component in the first direction and a second radial component in the second direction, the second radial component being greater than the second longitudinal component.

26. A turbomachine assembly comprising:

a casing;

a first rotor comprising a disk and a plurality of blades, the first rotor being movable in rotation relative to the casing around a longitudinal axis;

a second rotor movable in rotation relative to the casing around the longitudinal axis; and a damper configured to damp a movement of the first rotor relative to the second rotor in a plane orthogonal to the longitudinal axis, the movement being caused by a flapping of at least one of the plurality of blades relative to the disk, the damper comprising:

a first part bearing on the first rotor in a first area extending over a first angular sector around the longitudinal axis and being configured to apply a first centrifugal force on the first rotor;

a second part bearing on the first rotor in a second area different from the first area, the second area extending over a second angular sector around the longitudinal axis, the second angular sector being smaller than the first angular sector; wherein the second part comprises a channel configured to promote a radial deformation of the second part; and a third part bearing on the second rotor and being configured to apply a second centrifugal force on the second rotor.

* * * * *